US006307516B1

(12) United States Patent
Zafar et al.

(10) Patent No.: US 6,307,516 B1
(45) Date of Patent: Oct. 23, 2001

(54) ANTENNA FOR AUTOMOBILE RADIO

(75) Inventors: Imtiaz Zafar; Nazar F. Bally, both of Sterling Heights; Reed Clinton Schaefer, Swartz Creek, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/561,896

(22) Filed: May 1, 2000

(51) Int. Cl.[7] ..... H01Q 1/32; H01Q 1/02
(52) U.S. Cl. ..... 343/713; 343/704
(58) Field of Search ..... 343/713, 704, 343/711, 712

(56) References Cited

U.S. PATENT DOCUMENTS

| | | | | |
|---|---|---|---|---|
| 5,097,270 | * | 3/1992 | Lindenmeier et al. | 343/713 |
| 5,099,250 | | 3/1992 | Paulus et al. | 343/704 |
| 5,231,410 | * | 7/1993 | Murakami et al. | 343/713 |
| 5,293,173 | | 3/1994 | Kropielnicki et al. | 343/704 |
| 5,581,263 | * | 12/1996 | Maeda et al. | 343/713 |
| 5,610,619 | | 3/1997 | Zafar | 343/713 |
| 5,790,079 | | 8/1998 | Zafar | 343/713 |
| 5,933,119 | * | 8/1999 | Fujii et al. | 343/713 |
| 6,002,373 | * | 12/1999 | Taniguchi et al. | 343/713 |

* cited by examiner

*Primary Examiner*—Don Wong
*Assistant Examiner*—Hoang Nguyen
(74) *Attorney, Agent, or Firm*—Jimmy L. Funke

(57) ABSTRACT

An antenna system for a vehicle radio integrated with the defogger heating elements in a window that provides enhanced impedance matching without requiring lumped matching components. The antenna system includes a vehicle window, a conductive grid embedded in the vehicle window and having a plurality of horizontal and generally parallel conductive elements, and first and second bus bars connecting the grid at opposite ends. The antenna system has first and second vertical conductive elements embedded in the vehicle window and arranged substantially orthogonal to the horizontal conductive elements. Tuning elements are coupled to each of the first and second vertical conductive elements and are substantially orthogonal thereto. The tuning elements have a length selected so as to substantially match characteristic impedance of an RF signal path. The horizontal heating elements are engaged for heating the vehicle window during a heating operation, and also serves to receive radio signals for the radio.

16 Claims, 2 Drawing Sheets

ANTENNA FOR AUTOMOBILE RADIO

TECHNICAL FIELD

The present invention generally relates to an antenna system for a vehicle radio and, more particularly, to an antenna system for a vehicle radio in which the antenna elements are embedded in a vehicle window and employ the window defogger heating elements.

BACKGROUND OF THE INVENTION

Automotive vehicles are commonly equipped with a radio and a corresponding antenna system to receive amplitude modulation (AM) and frequency modulation (FM) broadcast radio signals. One conventional vehicle antenna system includes a mast antenna vertically extending from the body of the vehicle. Mast antennas are generally limited in signal performance, add wind noise and drag to the vehicle, and are susceptible to corrosion and damage.

Another conventional vehicle radio antenna includes a backlite antenna system in which antenna elements are embedded in a rear window of the vehicle. Examples of backlite antenna systems are disclosed in U.S. Pat. Nos. 5,610,619, 5,790,079, and 5,099,250. The vehicle antenna set forth in U.S. Pat. No. 5,099,250 utilizes the defogger elements encapsulated in the back window of the vehicle as antenna elements to receive broadcast radio signals. Conventional antenna systems that integrate the antenna with the defogger heating elements in the rear window of a vehicle typically require bifilar or toroidal chokes coupled between the conductive window elements and the vehicle DC power supply to separate the received antenna signal from the high current signals that heat the defogger elements. These chokes provide low impedance paths for the propagation of large current flow necessary to power the defogger heating elements, and high impedance paths against the propagation of the radio signals. The chokes are generally incorporated in an antenna impedance matching network in order to match the output of the antenna elements to the input of the amplifier associated with the vehicle radio to reduce the attenuation of power transfer from the antenna elements to the radio.

Typical impedance matching networks are specially designed and vary from one type of vehicle to other types of vehicles to realize the greatest efficiency in impedance matching. This is generally because the capacitance created between the conductive elements in the vehicle body varies from vehicle to vehicle. Further, prior art antenna grid patterns are often directional at FM frequencies, and have relatively low gain at AM frequencies.

It is therefore desirable to provide for an antenna system that employs the defogger heating elements in a vehicle window, such as the rear window, and includes an antenna impedance matching network that can be incorporated into a variety of vehicles. It is further desirable to provide for such an antenna system that does not require lumped matching components.

SUMMARY OF THE INVENTION

The present invention provides for an antenna system integrated with the defogger heating elements in a window to achieve enhanced impedance matching without requiring lumped matching components. To achieve this and other advantages and in accordance with the purpose of the present invention as embodied and described herein, the present invention provides for an antenna system for a radio of a vehicle comprising a vehicle window, a conductive grid formed in the vehicle window and having a plurality of horizontal and generally parallel conductive elements, first and second bus bars connecting the horizontal conductive elements at opposite ends. The antenna system has first and second vertical conductive elements embedded in the vehicle window and arranged substantially orthogonal to the horizontal conductive elements. A tuning element is coupled to each of the first and second vertical conductive elements and is substantially orthogonal thereto. The tuning element has a length selected so as to substantially match impedance of an RF signal path. The horizontal elements are energized to heat the vehicle window during a defogger heating operation, and also serve to receive radio signals for the radio.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
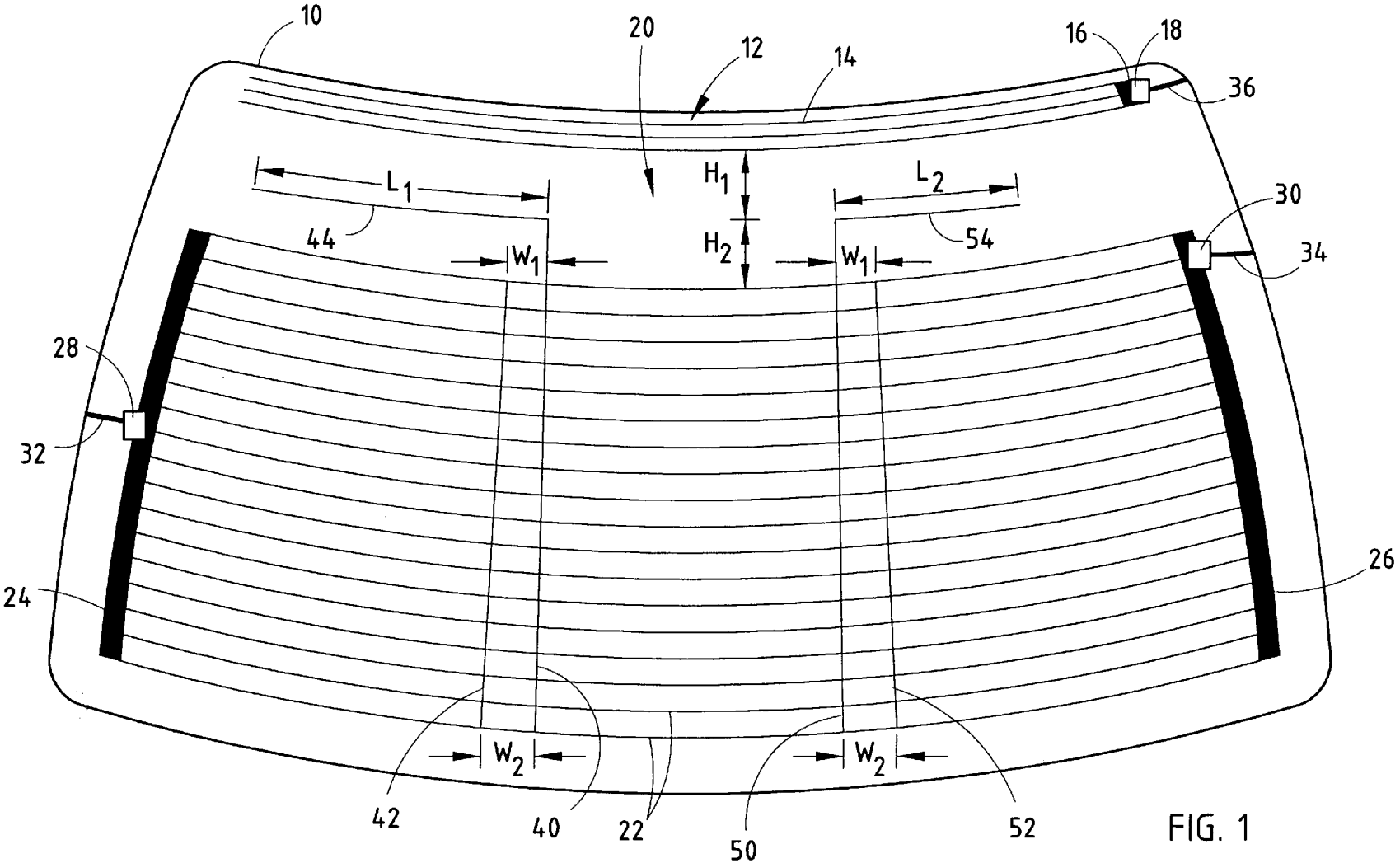
FIG. 1 is a front elevational view of a rear window of a vehicle incorporating an antenna system integrated with a defogger heating grid according to the present invention.

Referring to FIG. 1, the rear transparent window 10 of a vehicle, such as an automobile, is illustrated having an AM antenna 12 and a combination FM antenna and defogger grid 20 embedded within the transparent window 10. The AM antenna 12 is a stand-alone antenna for receiving amplitude modulation (AM) radio frequency (RF) signals. The FM antenna and defogger grid 20 is electrically energizeable to heat the window 10 to eliminate condensation and ice from the window, as is well understood in the art, and further is utilized as part of the FM antenna for receiving frequency modulation (FM) radio wave signals. It should be appreciated that the window 10 may have an outward curvature as is conventionally known in the vehicle window art.

The AM antenna 12 is shown generally made up of three horizontal and generally parallel conductive elements 14, each coupled at one end to a signal bus 16. The horizontal conductive elements 14 may be configured in different lengths and numbers. Signal bus 16 is coupled to a terminal output pad 18 which, in turn, is coupled to an insulated signal conductor 36 that provides a signal path for transmitting the received AM signals to a radio.

The FM antenna and defogger grid 20 is formed below AM antenna 12 and extends across a substantial area of window 10. The antenna and defogger grid 20 includes an array of horizontal and generally parallel conductive elements 22, each extending between a negative defogger bus bar 24 on the left side and a positive defogger bus bar 26 on the right side. Bus bars 24 and 26 are located near the left and right edges, respectively, of window 10. Negative defogger bus bar 24 contacts a terminal pad 28 which, in turn, is connected to an insulated wire 32 for providing a grounded signal connection to form the negative side of the defogger circuit. Positive defogger bus bar 26 likewise has a terminal pad 30 connected to an insulated wire 34 which receives DC power to form the positive side of the defogger circuit. Insulated wire 34 serves as an antenna feed pigtail and is kept as short in length as possible, preferably less than 250 mm. During the window defogging operation, bus bar 26 is energized with a positive DC voltage which generates current through each of the horizontal and generally parallel conductive elements 22 to heat window 10 to an elevated temperature for the purpose of eliminating condensation and ice from the window 10.

According to the present invention, the FM antenna 20 further includes first and second vertical conductive elements 40 and 50 coupled to each of horizontal conductive elements 22 and further extending vertically above the uppermost conductive element by a height $H_2$. Accordingly, the vertical elements 40 and 50 are arranged substantially orthogonal to horizontal elements 22 and cross each other to form crossing nodes. The first vertical conductive element 40 is connected to a substantially horizontal first tuning element 44 having a length $L_1$. Tuning element 44 is preferably arranged substantially orthogonal to vertical element 40. It should be appreciated that the length $L_1$ of tuning element 44 is selected so as to match the effective characteristic impedance on the output signal path 34 leading to a vehicle radio. The selection of length $L_1$ will generally vary from vehicle to vehicle, depending on the vehicle body construction.

The second vertical conductive element 50 is horizontally spaced apart from the first vertical conductive element 40. Connected to the second vertical conductive element 50 is a substantially horizontal second tuning element 54 having a length $L_2$. Tuning element 54 is preferably substantially orthogonal to vertical conductive element 50. The length $L_2$ of tuning element 54 is likewise selected so as to substantially match the effective characteristic impedance of the RF signal exiting on output signal path 34 leading to the radio.

The upper end of vertical conductive elements 40 and 50 and tuning elements 44 and 54 are preferably formed midway between the lower end (i.e., lowest element 14) of AM antenna 12 and the uppermost horizontal conductive element 22 of FM antenna 20. Accordingly, height $H_1$ is substantially equal to height $H_2$. It should be appreciated that first and second vertical conductive elements 40 and 50 with tuning elements 44 and 54 advantageously transform the characteristic impedance of the FM antenna and defogger grid 20 to a level where it becomes possible to match the characteristic impedance to the characteristic impedance of a coaxial cable RF signal path, which typically has an impedance in the range of 50 to 150 ohms.

In order to enhance the signal impedance match, and therefore increase the antenna sensitivity over the FM band frequency range, third and fourth vertical conductive elements 42 and 52 are further provided, one on either side of the corresponding vertical conductive elements 40 and 50. Third vertical conductive element 42 is substantially parallel to first vertical conductive element 40, but is horizontally offset and slightly out of alignment therewith. Accordingly, first and third vertical elements 40 and 42 have a separation width $W_1$ at the connection with the uppermost horizontal conductive element 22 and a separation width $W_2$ at the lowermost end termination with the bottom horizontal conductive element 22. Width $W_2$ is slightly larger than width $W_1$ so as to compensate for the curvature of window 10 and thereby provide a constant effective width therebetween.

The fourth vertical conductive element 52 is likewise horizontally offset and slightly out of alignment with second vertical conductive element 50. Second and fourth vertical conductive elements 50 and 52 also have a separation width $W_1$ at the connection with the uppermost horizontal element 22 and a slightly larger width $W_2$ at the termination on the lowermost horizontal element 22 so as to compensate for curvature of the window 10 and thereby provide a constant effective width therebetween. Accordingly, the addition of third and fourth vertical conductive elements 42 and 52 in proximity with and spaced from first and second vertical conductive elements 40 and 50, respectively, advantageously increases the antenna sensitivity over the FM frequency band.

Figure 2:
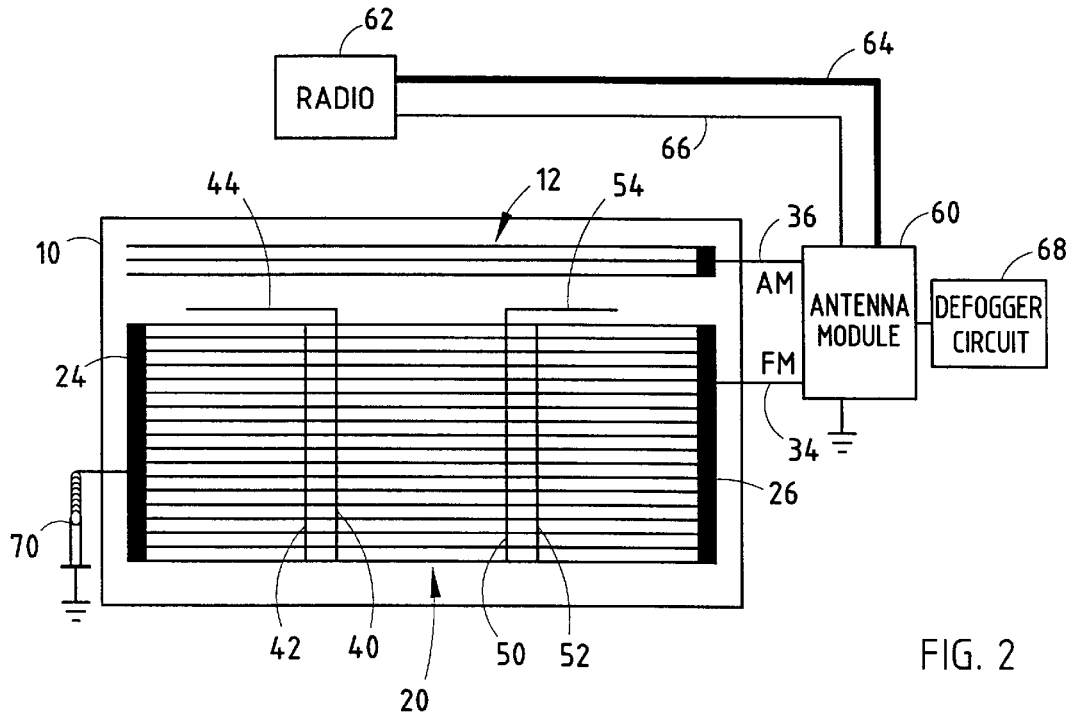
FIG. 2 is a block and diagrammatic view of the antenna system for use with the vehicle radio.

Referring to FIG. 2, the window 10 with AM antenna 12 and FM antenna 20 is shown coupled to an antenna module 60, which, in turn, is coupled to a vehicle radio 62 and a defogger circuit 68. Antenna module 60 receives AM radio wave signals from AM antenna 12 on the insulated wire 36 and FM radio wave signals from the FM antenna 20 on the insulated wire 34. The antenna module 60 allows the received AM and FM radio wave signals to pass therethrough and onto a coaxial cable 64 to car radio 62. The coaxial cable 64, as well as the insulated wire 34, provide an RF signal transmission path. In order to minimize the length of wire 34, the antenna module 60 is preferably packaged near the FM antenna 20, such as in the C-pillar of the vehicle. In addition, antenna module 60 is powered by a power signal on line 66 which may be supplied by radio 62.

The defogger circuit 68 is shown coupled through antenna module 60. Defogger circuit 68 controls energization of direct current (DC) power to the conductive defogger grid 20 for purposes of defogging the rear window 10. When a window defogger operation is requested, the defogger circuit 68 generates a high DC current in the range of approximately sixteen to thirty amps, which is transmitted through antenna module 60 to the positive defogger bus bar 26 via insulated wire 34. Also shown is a grounded FM trap 70 coupled to the negative defogger bus bar 24 for preventing FM signals from passing therethrough to ground. It should be appreciated that during the defogging operation, current is applied to the positive defogger bus bar 26 and passes to the negative defogger bus bar 24 through the horizontal conductive elements 22 and exits window 10 on wire 32 to FM trap 70 where the DC current passes to ground.

Figure 3:
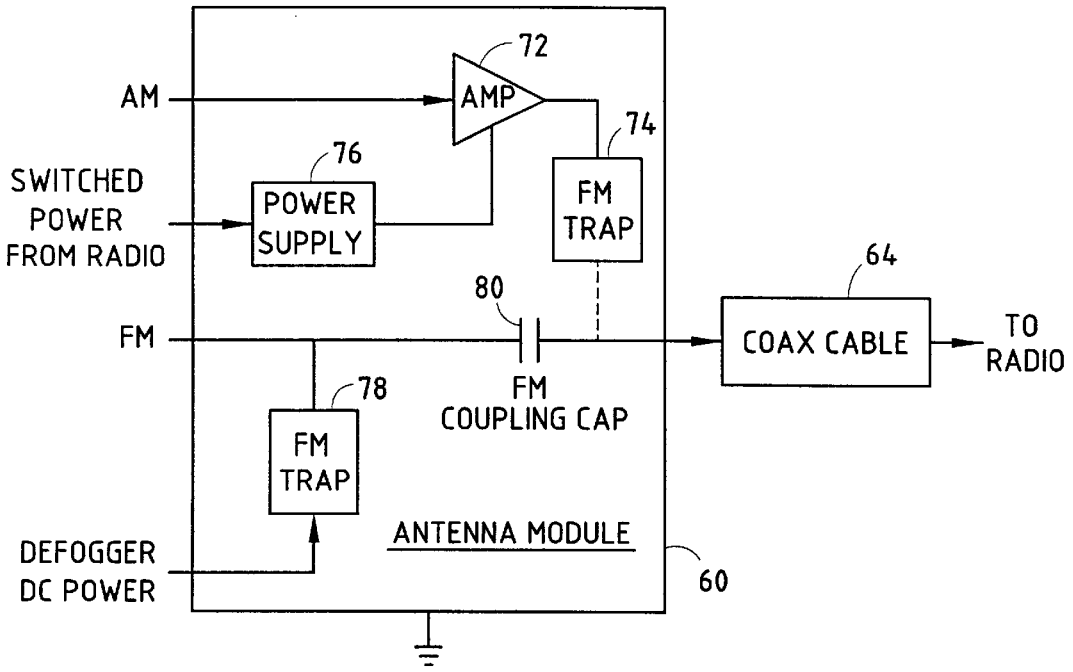
FIG. 3 is a circuit and block diagram of the antenna module shown in FIG. 2.

The antenna module 60 is further illustrated in more detail in FIG. 3. Antenna module 60 includes an amplifier 72 for amplifying the received AM signal, and an FM trap 74 for passing the amplified AM signal to the coaxial cable 64, while preventing FM signals from interfering with the AM amplification. The amplifier 72 is powered by a power supply 76 which, in turn, receives switched power from radio 62. Also included in antenna module 60 is an FM trap 78 that passes the defogger DC power received from the defogger circuit 68. FM trap 78 prevents FM signals received on FM antenna 20 from passing through the trap 78. It should be appreciated that FM traps 78, 74, and 70 advantageously float the conductive grid 20 so as to enable DC current to flow through the grid 20 during the defogging operation, while not interfering with the FM signal reception.

Also included in antenna module 60 is an FM coupling capacitor 80 coupled to FM signal line 34 for receiving the FM signal and passing the FM signal to the coaxial cable 64 for transmission to radio 62. The FM coupling capacitor 80 blocks the DC defogging current from flowing through the FM signal path and couples the FM signal to the coaxial cable 64 for transmission to the radio 62. The FM coupling capacitor 80 and FM trap 78 together serve as a filter to isolate received radio frequency signals from the defogger current signal.

The FM antenna 20 advantageously employs vertical conductive elements 40 and 50 with corresponding tuning elements 44 and 54 in a manner that transforms the high characteristic impedance generally found in standard defogger grid elements to a level where it is possible to match the effective characteristic impedance to the coaxial cable 64. The horizontal tuning elements 44 and 54 are selected in length so as to match the effective characteristic impedance of the coaxial cable 64. The length of tuning elements 44 and 54 are selected for the particular type of vehicle and may vary depending on the vehicle type. It should be appreciated that the length $L_1$ and $L_2$ of corresponding tuning elements 44 and 54 determines the voltage standing wave ratio (VSWR) which affects the effective impedance and radiating power efficiency of the antenna. In order to further enhance the impedance match and therefore increase the antenna sensitivity over the entire FM frequency band (88 to 108 MHz), vertical conductive elements 42 and 52 are further included.

According to one example, the FM antenna and defogger grid 20 employs an even number of horizontal conductive elements 22, such as 18 grid line elements as shown. However, any number of horizontal conductive elements 22 may be employed. In addition, FM antenna 20, in one example, may employ tuning elements 44 and 54 having length $L_1$ equal to 350 millimeters and $L_2$ equals 207 millimeters. Height $H_1$ and $H_2$ may both be equal to 32 millimeters. In addition, $W_1$ may be set equal to 50 millimeters, while $W_2$ may be set equal to 60 millimeters. The aforementioned specific dimensions and other physical characteristics relating to the example disclosed herein are not to be considered as limiting, unless the claims expressly state otherwise.

Accordingly, the FM antenna grid 20 of the present invention advantageously provides for FM signal reception with an antenna that utilizes the defogger heating grid in a rear window of a vehicle. The horizontal conductive elements 22 operate to receive horizontally polarized FM radio wave signals. The FM antenna grid 20 advantageously employs vertical conductive elements 40, 42, 50 and 52 to receive vertically polarized radio wave signals, and further employs the tuning elements 44 and 54 to match the effective characteristic impedance of the RF signal path coaxial cable 64, and thereby eliminates the need for conventional lumped matching components to provide special impedance matching as is generally required in most conventional rear window radio antennas. While the present invention has been described in connection with an FM antenna combined with a rear window defogger in the rear window of a vehicle, it should be appreciated that other types of signal reception may be employed, and various types of windows may be employed without departing from the teachings of the present invention.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. An antenna system for a radio of a vehicle, said antenna system comprising:

a vehicle window;

a conductive grid formed in the vehicle window and having a plurality of horizontal and generally parallel conductive elements for heating the vehicle window during a heating operation;

first and second bus bars connecting the horizontal conductive elements at opposite ends;

first and second vertical conductive elements embedded in said vehicle window and arranged substantially orthogonal to said horizontal conductive elements;

a first tuning element coupled to said first vertical conductive element and substantially orthogonal thereto, wherein said first tuning element has a length selected so as to substantially match a characteristic impedance of an RF signal transmission path; and a feed line coupled to one of the first and second bus bars, wherein the feed line transmits current to the conductive elements during the heating operation and further transmits RF radio wave signals.

2. The antenna system as defined in claim 1 further comprising a second tuning element coupled to said second vertical conductive element and substantially orthogonal thereto, wherein said second tuning element has a length selected so as to substantially match a characteristic impedance of the RF signal transmission path.

3. The antenna system as defined in claim 1 further comprising third and fourth vertical conductive elements coupled to said horizontal conductive elements and spaced from said first and second vertical conductive elements.

4. The antenna system as defined in claim 3, wherein said third vertical conductive element is substantially parallel to said first conductive element, and said fourth vertical conductive element is substantially parallel to said second vertical conductive element.

5. The antenna system as defined in claim 1, wherein said RF signal transmission path comprises a coaxial cable electrically coupled to said antenna system and adapted to be coupled to a radio.

6. The antenna system as defined in claim 1 further comprising an antenna module including a filter for isolating received RF signals from a heating current signal.

7. The antenna system as defined in claim 1, wherein said first tuning element is disposed substantially midway between one end of said horizontal conductive elements and an end of another antenna.

8. The antenna system as defined in claim 1, wherein said antenna system comprises an FM antenna system.

9. An antenna provided in a vehicle window and operative with an array of heating elements, said antenna comprising:

a vehicle window;

a conductive heating grid formed in the vehicle window and having a plurality of horizontal and generally parallel conductive elements for heating the vehicle window during a heating operation;

a first vertical conductive element connected to said horizontal heating elements and arranged substantially orthogonal thereto;

a second vertical conductive element connected to said horizontal heating elements and arranged substantially orthogonal thereto;

a first tuneable conductive element connected to said first vertical conductive element, said tuneable conductive element being located substantially orthogonal to said first vertical conductive element and having a first length selected so as to substantially match a characteristic impedance of an RF signal transmission path;

a second tuneable conductive element connected to said second vertical conductive element, said tuneable conductive element being located substantially orthogonal to said second vertical conductive element and having a second length selected so as to substantially match the characteristic impedance of the RF signal transmission path; and a feed line coupled to one of the first and second bus bars, wherein the feed line transmits current to the conductive elements during the heating operation and further transmits RF radio wave signals.

10. The antenna system as defined in claim 9 further comprising third and fourth vertical conductive elements coupled to said horizontal heating elements and separate from said first and second vertical conductive elements.

11. The antenna system as defined in claim 9, wherein said RF signal transmission path comprises a coaxial cable electrically coupled to said antenna system and adapted to be connected to a radio.

12. An antenna system for a radio of a vehicle, said antenna system comprising:

a vehicle window;

a conductive grid formed in the vehicle window and having a plurality of horizontal and generally parallel conductive elements for heating the vehicle window during a heating operation;

first and second bus bars connecting the horizontal conductive elements at opposite ends;

a first vertical conductive element formed in the vehicle window and arranged substantially orthogonal to said horizontal conductive elements;

a second vertical conductive element formed in said vehicle window and arranged substantially orthogonal to said horizontal conductive elements;

a third vertical conductive element formed in said vehicle window and arranged substantially orthogonal to said horizontal conductive elements;

a fourth vertical conductive element formed in said vehicle window and arranged substantially orthogonal to said horizontal conductive elements, wherein said first, second, third and fourth vertical conductive elements are spaced apart from one another; and a feed line coupled to one of the first and second bus bars, wherein the feed line transmits current to the conductive elements during the heating operation and further transmits RF radio wave signals.

13. The antenna system as defined in claim 12 further comprising a first tuning element coupled to said first vertical conductive element and arranged substantially orthogonal thereto, wherein said first tuning element has a length selected so as to substantially match a characteristic impedance of an RF signal transmission path.

14. The antenna system as defined in claim 13 further comprising a second tuning element coupled to said second vertical conductive element and arranged substantially orthogonal thereto, wherein said second tuning element has a length selected so as to substantially match a characteristic impedance of the RF signal transmission path.

15. The antenna system as defined in claim 13, where in said RF signal transmission path comprises a coaxial cable electrically coupled to said antenna system and adapted to be connected to a radio.

16. The antenna system as defined in claim 12, wherein said first and third vertical conductive elements are substantially parallel to each other and spaced from one another by a first separation distance, and wherein said second and fourth vertical conductive elements are substantially parallel and spaced from one another by a second separation distance, such that first and second separation distances are substantially equal.

* * * * *